US011431129B2

(12) United States Patent
Wang et al.

(10) Patent No.: US 11,431,129 B2
(45) **Date of Patent: *Aug. 30, 2022**

(54) ELECTRICAL CONNECTOR

(71) Applicants: FU DING PRECISION INDUSTRIAL (ZHENGZHOU) CO.,LTD., Zhengzhou (CN); FOXCONN INTERCONNECT TECHNOLOGY LIMITED, Grand Cayman (KY)

(72) Inventors: Rui-Qin Wang, Kunshan (CN); Yen-Chih Chang, New Taipei (TW)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 17/137,412

(22) Filed: Dec. 30, 2020

(65) Prior Publication Data

US 2021/0203109 A1 Jul. 1, 2021

(30) Foreign Application Priority Data

Dec. 31, 2019 (CN) ..... 201911405638.2

(51) Int. Cl.

| | |
|---|---|
| ***H01R 4/66*** | (2006.01) |
| ***H01R 13/6471*** | (2011.01) |
| ***H01R 12/73*** | (2011.01) |
| ***H01R 13/6587*** | (2011.01) |
| ***H01R 12/71*** | (2011.01) |

(Continued)

(52) U.S. Cl.

CPC ..... *H01R 13/6471* (2013.01); *H01R 12/55* (2013.01); *H01R 12/716* (2013.01); *H01R 12/73* (2013.01); *H01R 13/518* (2013.01); *H01R 13/6587* (2013.01)

(58) Field of Classification Search

CPC ..... H01R 13/6461; H01R 13/6471; H01R 13/518; H01R 13/6587; H01R 12/55; H01R 12/73; H01R 12/716

USPC ..... 439/92, 108

See application file for complete search history.

(56) References Cited

U.S. PATENT DOCUMENTS

| | | | |
|---|---|---|---|
| 6,202,118 | B1 | 3/2001 | Klein |
| 6,899,566 | B2 | 5/2005 | Kline et al. |
| 6,988,902 | B2 | 1/2006 | Winings et al. |

(Continued)

FOREIGN PATENT DOCUMENTS

| | | |
|---|---|---|
| CN | 202034538 | 11/2011 |
| CN | 202454772 | 9/2012 |

(Continued)

*Primary Examiner* — Khiem M Nguyen

(74) *Attorney, Agent, or Firm* — Ming Chieh Chang; Wei Te Chung

(57) ABSTRACT

An electrical connector includes: a housing; and plurality terminal groups held on the housing, each terminal group including a pair of signal terminals, a first shielding sheet for shielding the pair of signal terminals on at least one side, and a second shielding sheet for shielding the signal terminals on at least another side; wherein the first shielding sheet and the second shielding sheet of each terminal group are electrically connected, and the first shielding sheet of one of the terminal groups is electrically connected to the second shielding sheet of an adjacent terminal group.

20 Claims, 12 Drawing Sheets

(51) Int. Cl.
*H01R 12/55* (2011.01)
*H01R 13/518* (2006.01)

(56) References Cited

U.S. PATENT DOCUMENTS

| | | | |
|---|---|---|---|
| 7,785,148 | B2 | 8/2010 | Pan |
| 8,465,302 | B2 | 6/2013 | Regnier et al. |
| 8,715,005 | B2 | 5/2014 | Pan |
| 8,905,786 | B2 | 12/2014 | Davis et al. |
| 8,920,195 | B2 | 12/2014 | Cohen et al. |
| 8,961,227 | B2 | 2/2015 | Gailus et al. |
| 8,961,229 | B2 | 2/2015 | Pan |
| 9,077,094 | B2 | 7/2015 | Minich |
| 9,356,401 | B1 | 5/2016 | Horning et al. |
| 9,407,045 | B2 | 8/2016 | Horning et al. |
| 9,748,698 | B1 | 8/2017 | Morgan et al. |
| 9,831,588 | B2 | 11/2017 | Cohen |
| 10,038,282 | B2 | 7/2018 | De Geest et al. |
| 10,170,869 | B2 | 1/2019 | Gailus et al. |
| 10,205,286 | B2 | 2/2019 | Provencher et al. |
| 10,355,416 | B1 | 7/2019 | Pickel et al. |
| 10,644,453 | B2 | 5/2020 | Laurx et al. |
| 10,686,282 | B1 | 6/2020 | McCarthy et al. |
| 10,707,626 | B2 | 7/2020 | Cartier, Jr. et al. |

FOREIGN PATENT DOCUMENTS

| | | |
|---|---|---|
| CN | 204668627 | 9/2015 |
| CN | 102904119 | 6/2016 |
| CN | 104167620 | 8/2017 |
| CN | 104718666 | 8/2018 |
| CN | 109494499 | 3/2019 |
| CN | 105470736 | 8/2019 |

ELECTRICAL CONNECTOR

BACKGROUND OF THE INVENTION

1. Field of the Invention

The present invention relates generally to an electrical connector, and more particularly to an electrical connector with a ground shielding.

2. Description of Related Arts

China Patent No. 104718666 discloses an electrical connector comprising a housing and a plurality of terminal groups held in the housing. Each of the terminal groups includes a signal terminal and a shielding sheet for shielding the signal terminal. However, the shielding sheets are not electrically connected to each other, and crosstalk is prone to occur during signal transmission.

An improved electrical connector is desired.

SUMMARY OF THE INVENTION

A main object of the present invention is to provide an electrical connector with good shielding effect and simple manufacturing process.

To achieve the above-mentioned object, an electrical connector comprises: a housing; and a plurality of terminal groups held on the housing, each terminal group including: a pair of signal terminals, a first shielding sheet for shielding the pair of signal terminals on at least one side, and a second shielding sheet for shielding the signal terminals on at least another side; wherein the first shielding sheet and the second shielding sheet of each terminal group are electrically connected, and the first shielding sheet of one of the terminal groups is electrically connected to the second shielding sheet of an adjacent terminal group.

Compared to the prior art, in the electrical connector of the present invention, the first shielding sheet and the second shielding sheet of the same terminal group are electrically connected, and the first shielding sheet and the second shielding sheet of the adjacent terminal group are electrically connected to form a large ground loop, which effectively reduces the crosstalk problem in the transmission path.

DETAILED DESCRIPTION OF THE PREFERRED EMBODIMENT

Figure 1:
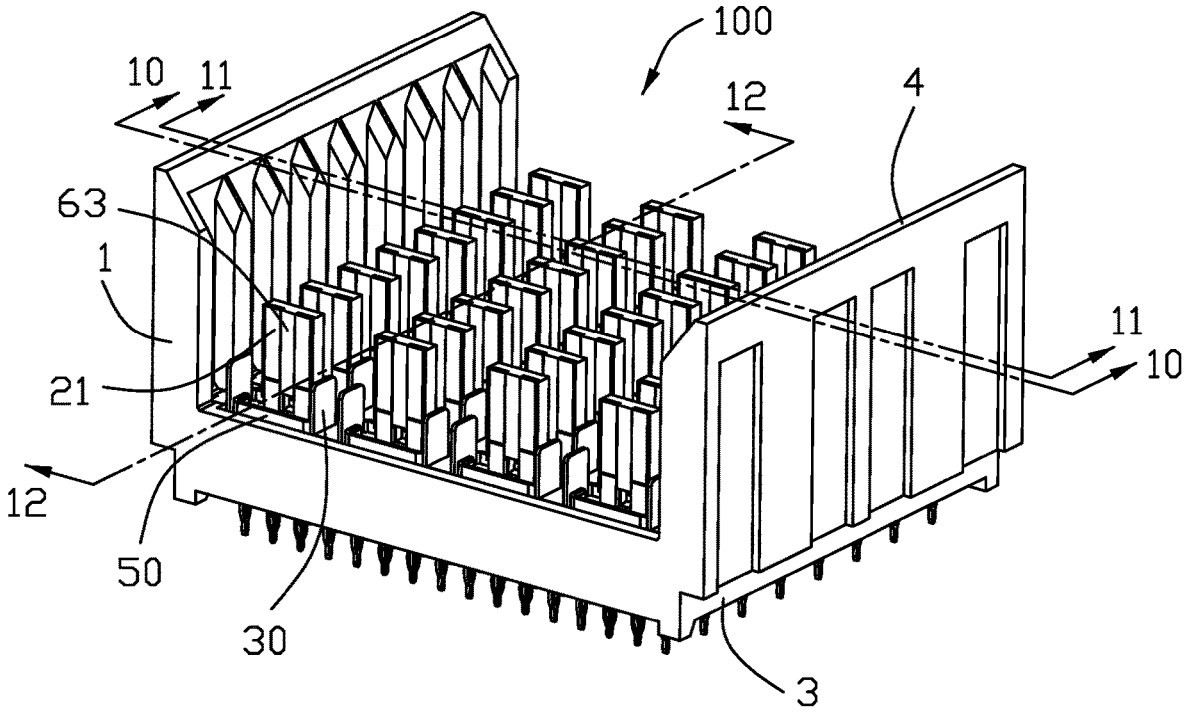
FIG. 1 is a perspective view of an electrical connector in accordance with the present invention.
Figure 2:
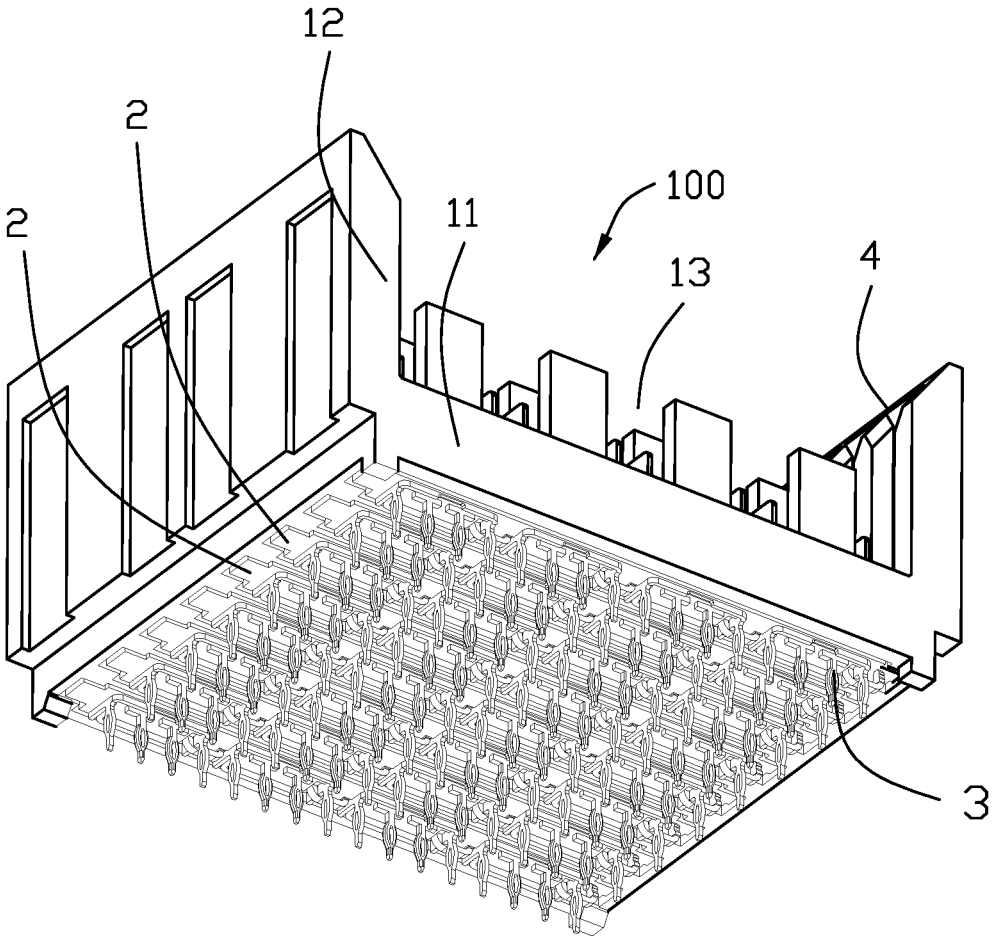
FIG. 2 is another perspective view of the electrical connector in FIG. 1.
Figure 3:
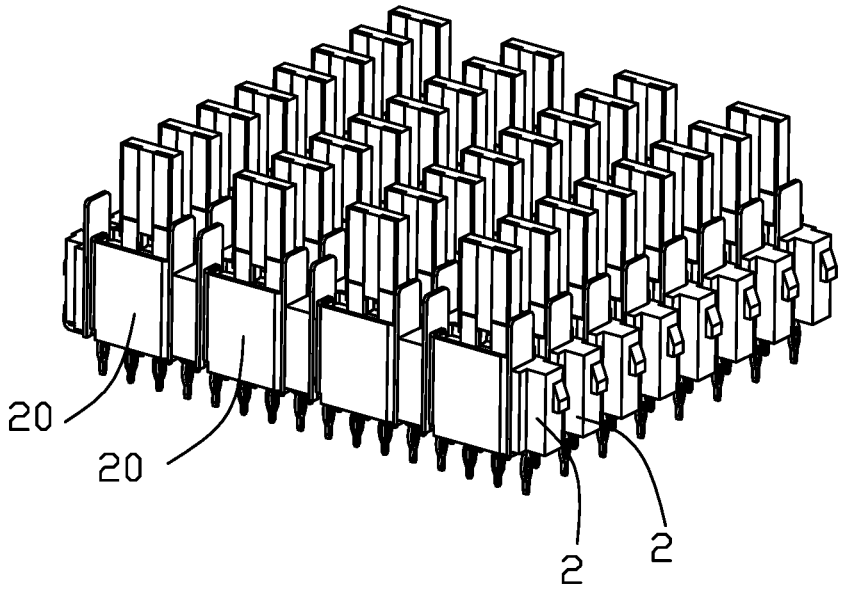
FIG. 3 is a partial exploded view of the electrical connector in FIG. 1.
Figure 3:
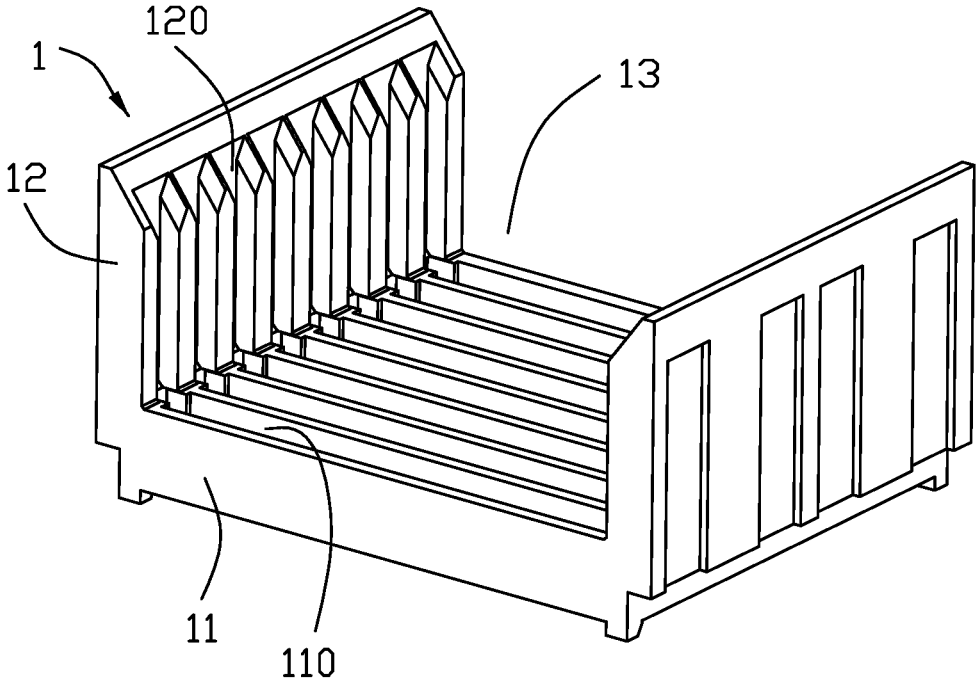
Figure 4:
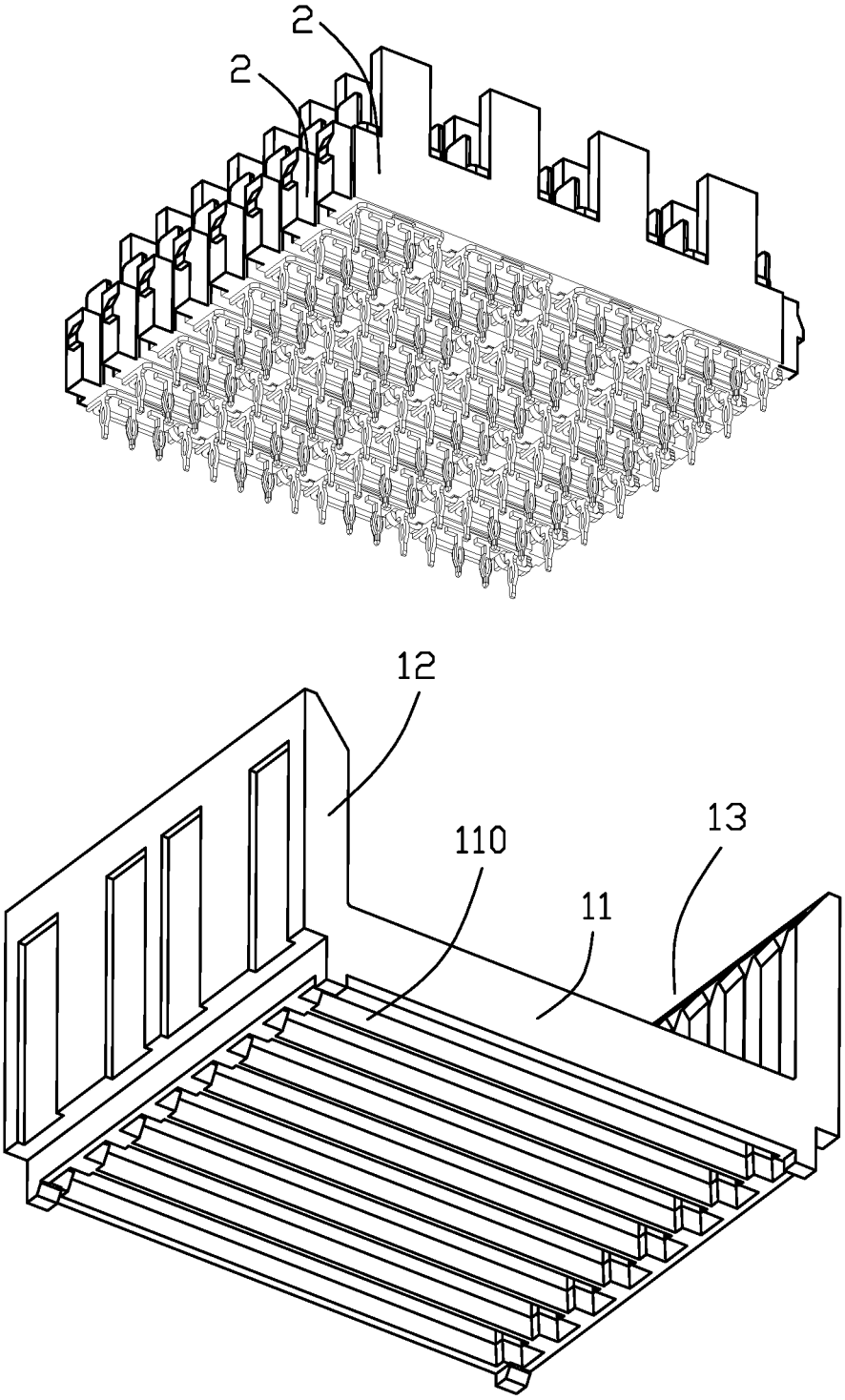
FIG. 4 is another partial exploded view of the electrical connector in FIG. 3.
Figure 5:
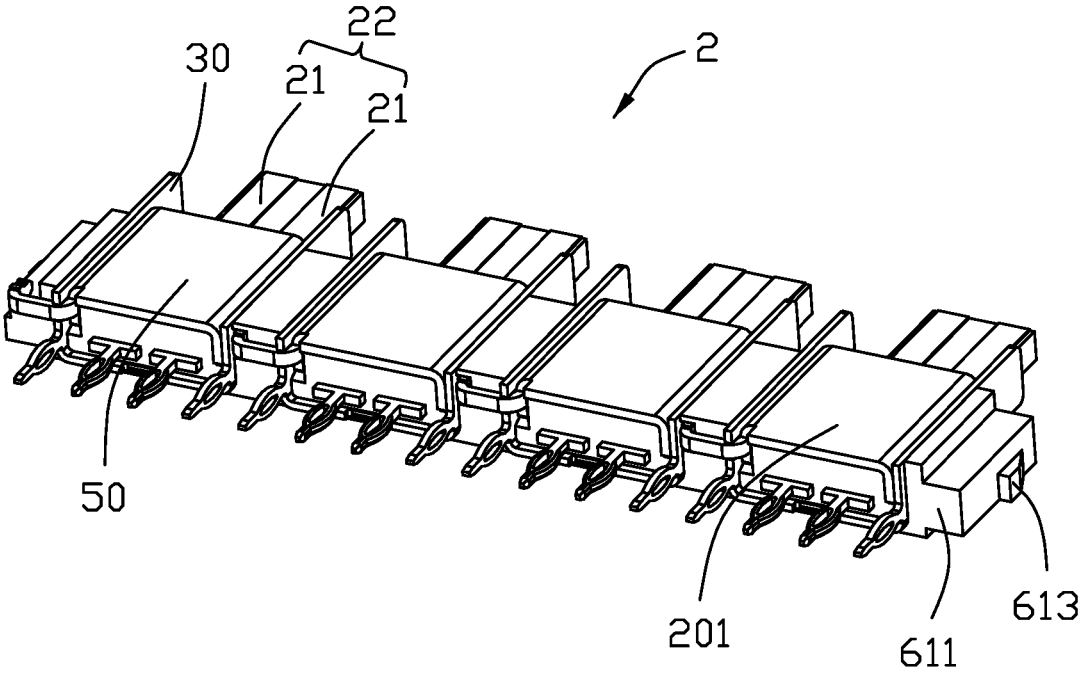
FIG. 5 is a perspective view of the terminal module of the electrical connector in FIG. 3.
Figure 6:
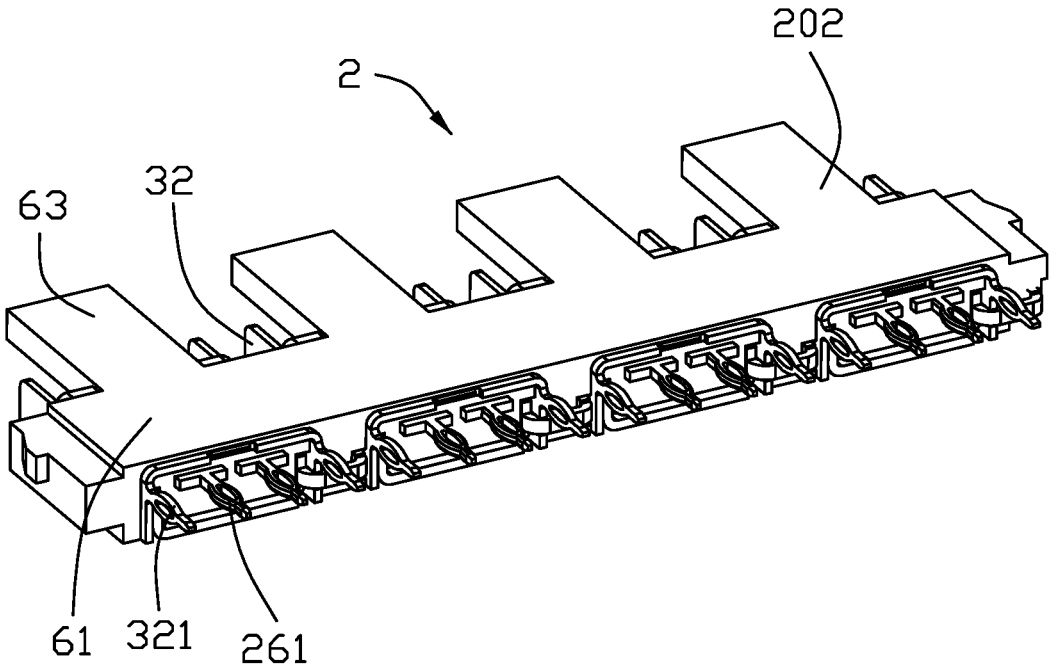
FIG. 6 is another perspective view of the terminal module of the electrical connector in FIG. 5.
Figure 7:
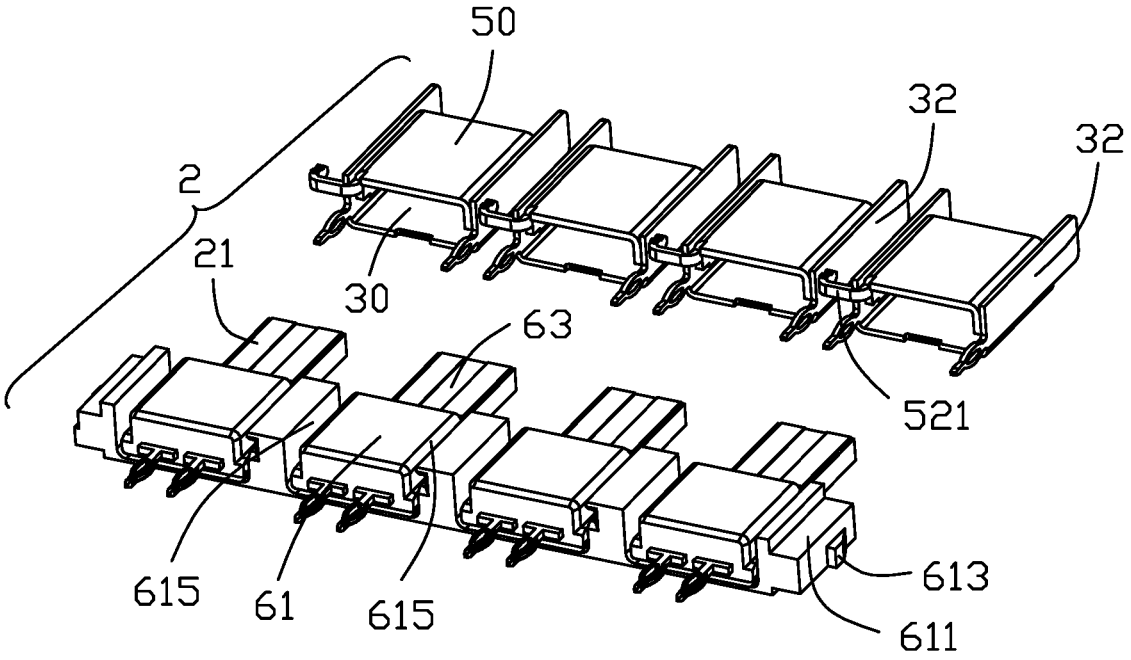
FIG. 7 is a partial exploded view of the terminal module in FIG. 5.
Figure 8:
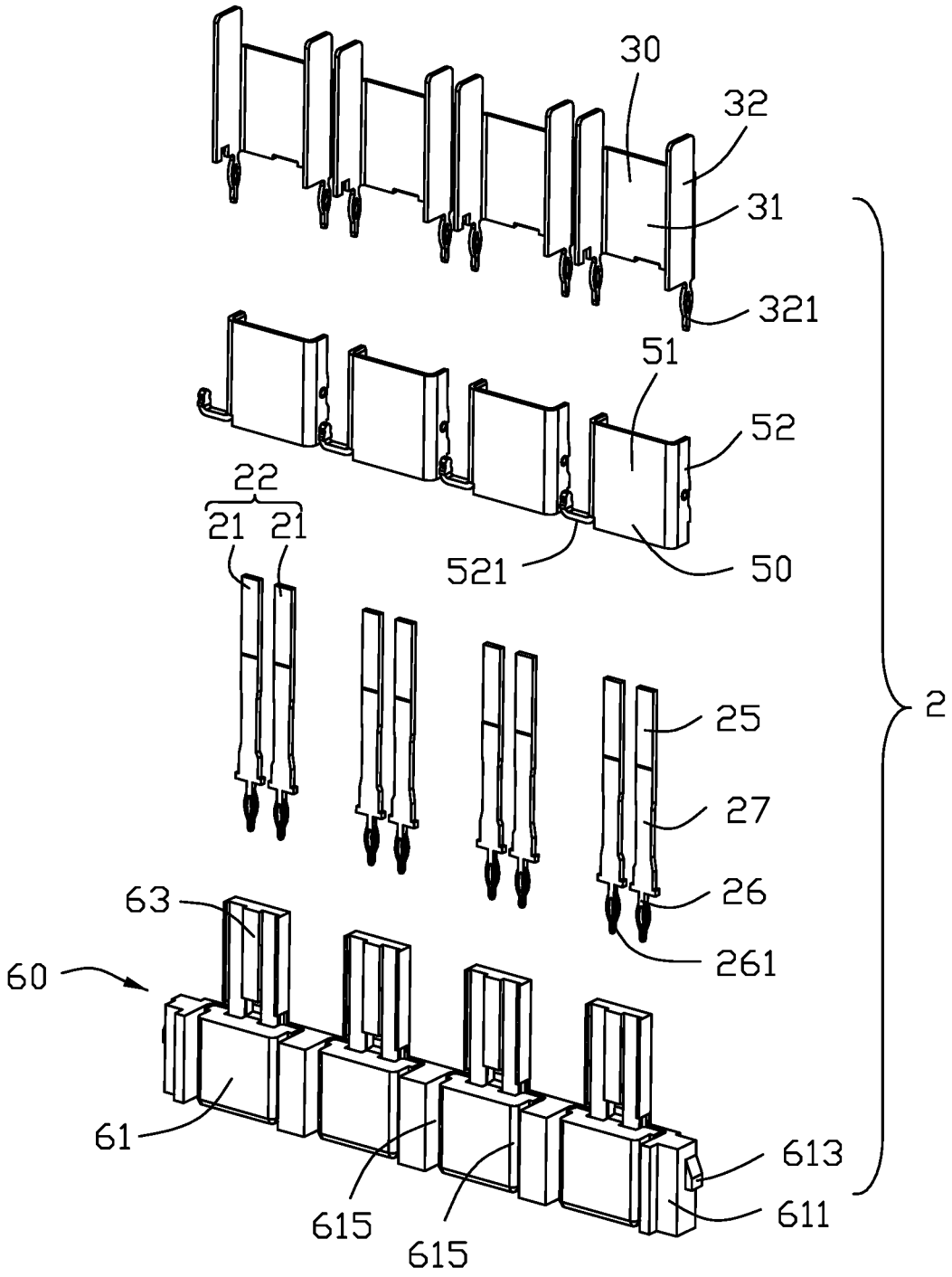
FIG. 8 is a further exploded view of the terminal module in FIG. 7.
Figure 9:
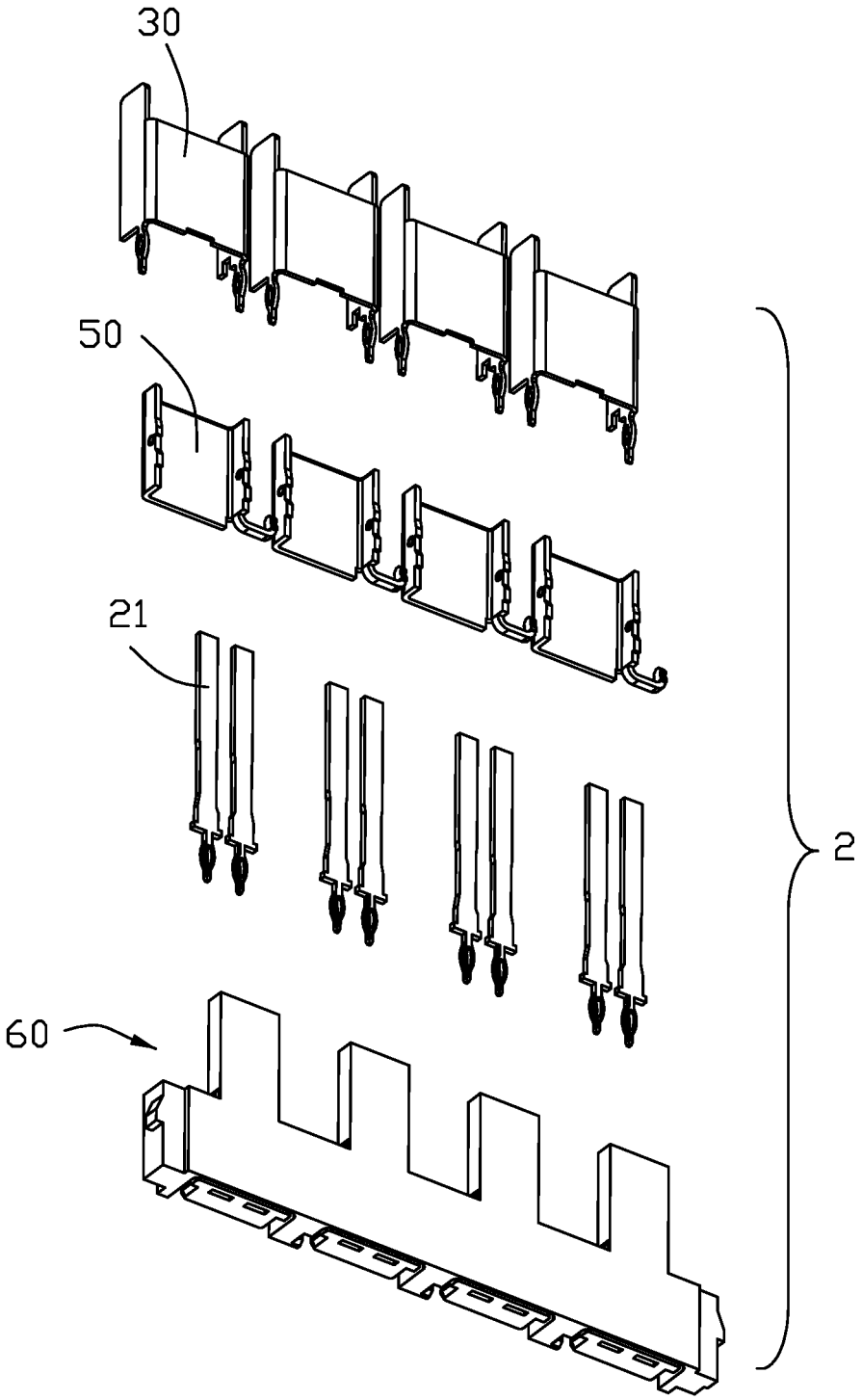
FIG. 9 is another exploded view of the terminal module in FIG. 8.
Figure 10:
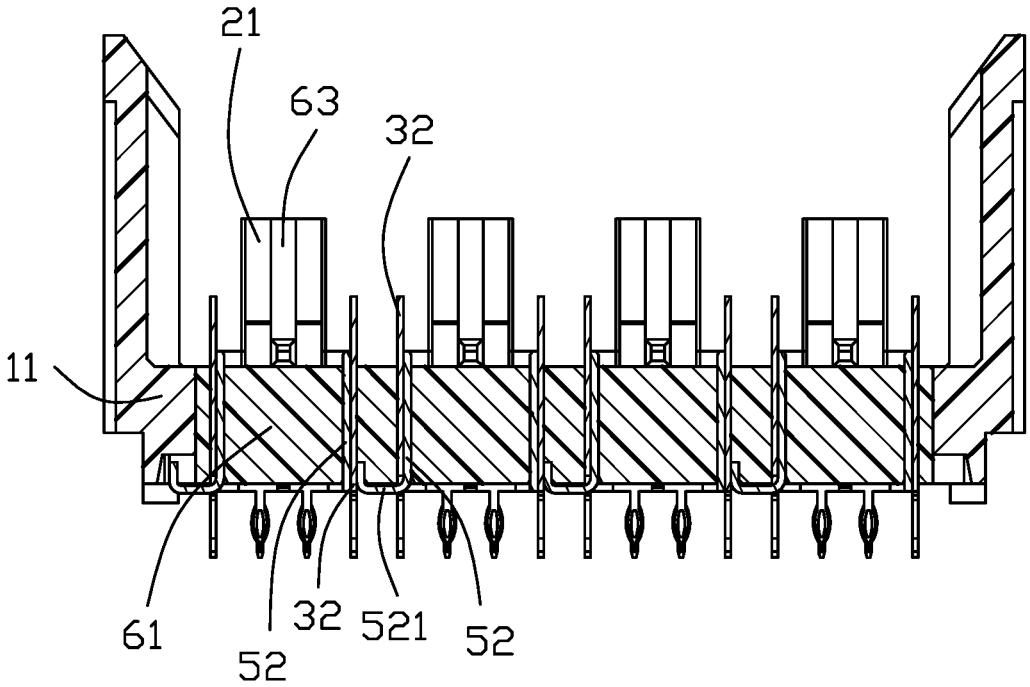
FIG. 10 is a cross-sectional view taken along line 10-10 of the electrical connector in FIG. 1.
Figure 11:
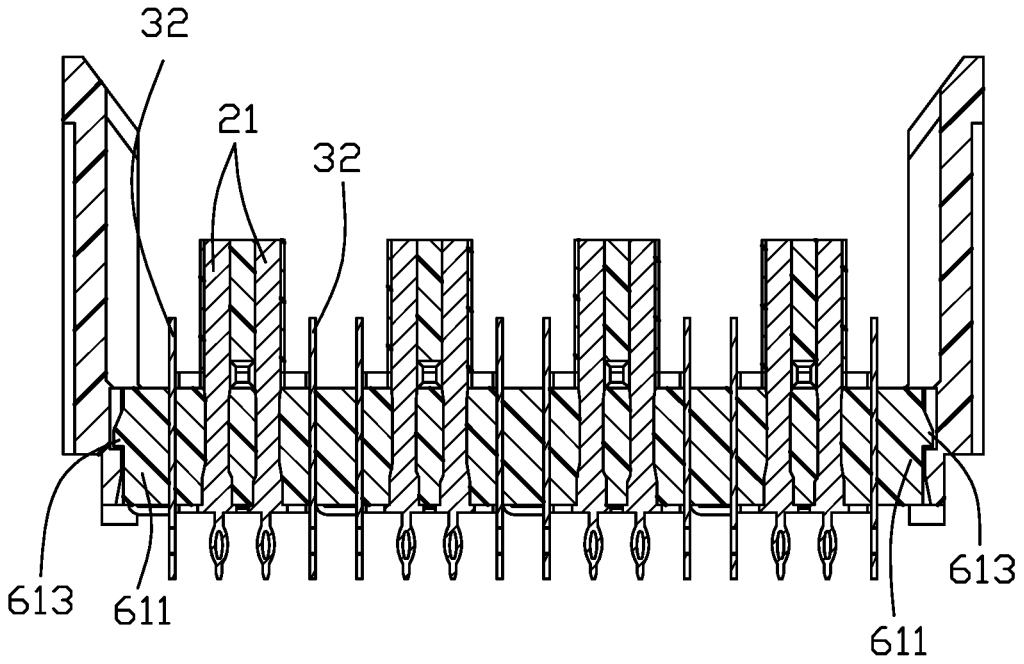
FIG. 11 is a cross-sectional view along line 11-11 of the electrical connector in FIG. 1.
Figure 12:
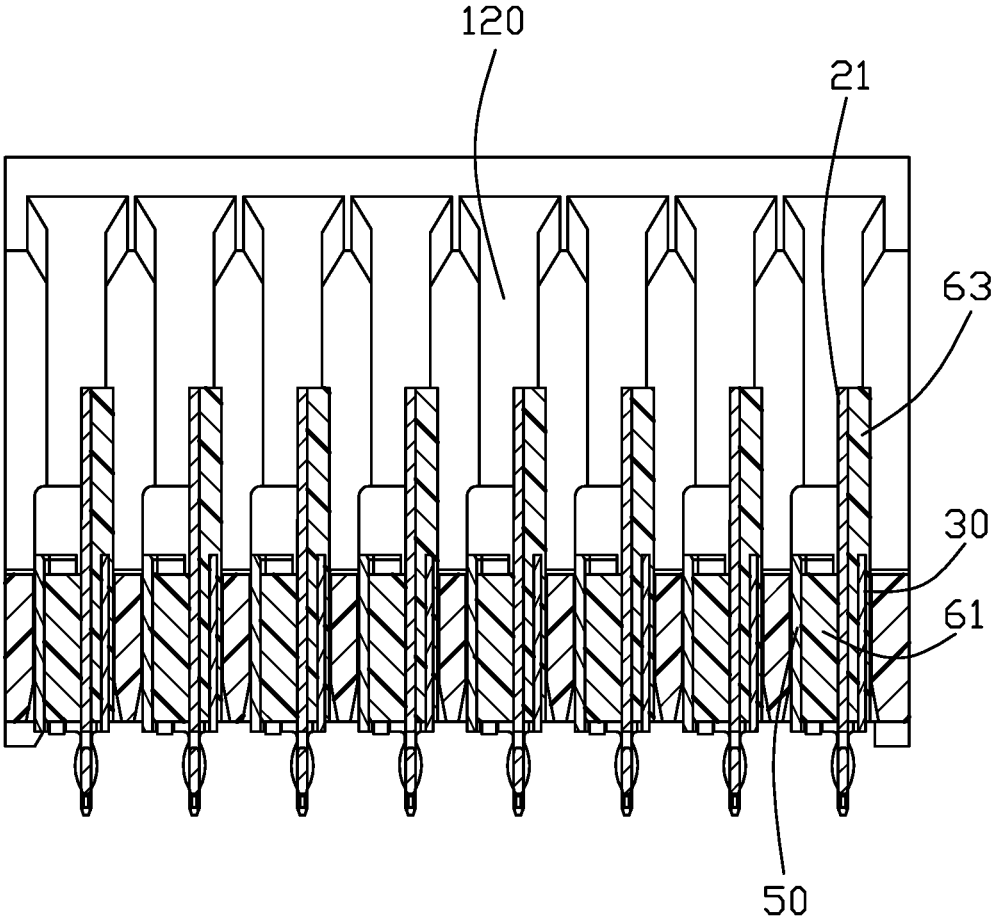
FIG. 12 is a cross-sectional view along line 12-12 of the electrical connector in FIG. 1.

Referring to FIGS. 1-12, an electrical connector 100 of the present invention is used to be mounted on a circuit board (not shown) and can be mated with a mating connector (not shown). The electrical connector 100 includes an insulating housing 1 and a plurality of terminal modules 2 arranged in rows and fixed on the insulating housing 1. Each of the terminal modules 2 includes a number of terminal groups 20 arranged in rows. Each of the terminal group 20 includes a pair of signal terminals 21, a first shielding sheet 30 that shields the signal terminals 21, and a second shielding sheet 50 that cooperates with the first shielding sheet 30 to shield the signal terminals 21. For easy understanding, in this embodiment, the side where the electrical connector 100 is mounted on the circuit board is defined as the mounting side or lower side 3, and the side opposite to the mounting side is defined as the mating side or upper side 4.

The insulating housing 1 includes a bottom wall 11 and a pair of parallel and spaced side walls 12 extending upward from the bottom wall 11. The bottom wall 11 and the pair of side walls 12 form a receiving space 13.

The two side walls 12 of the insulating housing 1 are respectively provided with groove 120, The groove 120 is used to guide the terminal module 2 to cooperate with the insulating housing 1. The bottom wall 11 is provided with a plurality of through grooves 110 penetrating the bottom wall 11. The signal terminals 21 are arranged in the form of a differential signal terminal pair 22 for transmitting a pair of differential signals. The signal terminal 21 includes a contact portion 25 that extends into the receiving space 13 to fit with the mating connector, a mounting portion 26 for mounting on the circuit board, and a body portion 27 connecting the contact portion 25 and the mounting portion 26. The mounting portion 26 is provided with a contact foot 261 of an eye-of-needle structure. The contact foot 261 extends out of the bottom wall 11 of the insulating housing 1 and is electrically connected to the circuit board.

The first shielding sheet 30 includes a main wall 31 and a pair of side walls 32 respectively extending from both ends of the main wall 31 along the same side. The main wall 31 and the pair of side walls 32 jointly enclose a U-shaped shielding space. The first shielding sheet 30 includes mounting feet 321 for mounting on the circuit board. The mounting feet 321 include two, and they respectively extend from two corresponding side walls 32. The second shielding sheet 50 includes a main wall/plate 51 and a pair of side walls/plates 52 extending along the same side from both ends of the main wall 51. The main wall 51 and the pair of side walls 52 jointly enclose a U-shaped shielding space. The first shielding sheet 30 is matched with the side of the U-shaped opening of the second shielding sheet 50 of the same terminal group 20 along the side of the U-shaped opening. Thus a pair of differential signal terminals 22 is completely surrounded from the circumferential direction. The inner side of the two side walls 32 of the first shielding sheet 30 and the outer side of the two side walls 52 of the second shielding sheet 50 are in contact with each other and are electrically connected. An extension arm 521 is provided on the side wall 52 of the second shielding sheet 50 of each terminal group 20. The extension arm 521 extends from the lower edge of the side wall 52 and electrically connects to the outer side of the adjacent side wall 32 of the first shielding sheet 30 of the adjacent terminal group 20. The extension arm 521 and the second shielding sheet 50 can be formed by integral punching and then bending. If desired, the extension arm 521 may not be integrally stamped with the second shielding sheet 50, but welded or soldered to the second shielding sheet 50.

The terminal module 2 further includes a fixing member 60. All the differential signal terminal pairs 22 in the same terminal module 2 are sequentially arranged in the lateral direction. Each of the first shielding sheets 30 is also sequentially arranged in the transverse direction, which also can be deemed as the longitudinal direction along which the groove 110 extends, and shields one side of the corresponding differential signal terminal pair 22. All the differential signal terminal pairs 22 and all the first shielding sheets 30 are integrally formed on the fixing member 60. The terminal module 2 includes a first side 201 and a second side 202 in the column direction. Each of the fixing members 60 includes a holding portion 61 installed on the insulating housing 1 and a plurality of extension portions 63 extending from the upper side of the holding portion 61 into the receiving space 13. Both sides of the holding portion 61 in the transverse direction are respectively provided with mounting blocks 611 extending outward. The mounting block 611 is installed in the through groove 110 on the bottom wall of the insulating housing 1 along the groove 120. Each mounting block 611 is provided with a positioning protrusion 613 protruding outward. Each of the extensions portions 63 corresponds to one differential signal terminal pairs 22. The body portion 27 of each signal terminal 21 is completely molded and covered in the holding portion 61 of the fixing member 60. One wide side and two narrow sides of the contact portion 25 are molded and wrapped in the extension portion 63 of the fixing member 60. The other wide side is exposed from the first side 201. The main wall 31 of each first shielding sheet 30 is partially molded and covered in the fixing member 60, and partly extending out from the upper side of the fixing member 60 of the fixing member 60. The fixing members 60 on both sides of each differential signal terminal pair 22 are provided with mounting grooves 615. The outer sides of the two side walls 32 of the first shielding sheet 30 are molded in the fixing member 60. The inside is exposed from the corresponding mounting groove 615. The inner sides of the two side walls 32 are exposed from the corresponding mounting groove 615. The two side walls 52 of the second shielding sheet 50 are respectively received in the corresponding mounting grooves 615, and the outer sides of the two side walls 52 of the second shielding sheet 50 are in contact with the inner sides of the corresponding side walls 32 of the first shielding sheet 30 and are electrically connected. In this embodiment, each of the terminal modules 2 includes four differential signal terminal pairs 22 and four first shielding sheets 30 and four second shielding sheets 50 that shield the differential signal terminal pairs 22. The fixing member 60 fixes the four differential signal terminal pairs 22 and the corresponding four first shielding sheets 30 into a whole, and then assembles them on the insulating housing 1. The second shielding sheet 50 is assembled and fixed in the fixing member 60 from lower to upper.

In the electrical connector 100 of the present invention, the first shielding sheet 30 and the second shielding sheet 50 of each terminal group 20 of each terminal module 2 cooperate with each other to completely surround a pair of the signal terminals 21 from the circumferential direction. And the second shielding sheet 50 is provided with an extension arm 521 connected with the first shielding sheet 30 of the adjacent terminal group 20, connect the other first shielding sheet 30 and the second shielding sheet 50 in the loop in turn to form a larger connection loop, so as to solve the crosstalk problem in the transmission path. In assembling the electrical connector 100, first, all the signal terminals 21 and the first shielding sheet 30 in the same row are fixed as a whole through a molding process. Then the whole structure is assembled and fixed in the bottom wall 11 on the insulating housing 1, and the second shielding sheet 50 is assembled. The connector of the present invention has less components and requires less molds, and is simple to assemble and has low cost.

What is claimed is:

1. An electrical connector comprising:

a housing; and a plurality of terminal groups held on the housing, each terminal group including:

a pair of signal terminals;

a first shielding sheet for shielding the pair of signal terminals on at least one side; and a second shielding sheet for shielding the signal terminals on at least another side; wherein the first shielding sheet and the second shielding sheet of each terminal group are electrically connected, and the first shielding sheet of one of the terminal groups is electrically connected to the second shielding sheet of an adjacent terminal group.

2. The electrical connector as claimed in claim 1, wherein each of the first shielding sheet and the second shielding sheet includes a main wall and a pair of side walls extending from the main wall.

3. The electrical connector as claimed in claim 2, wherein the first shielding sheet and the second shielding sheet of each terminal group together completely surrounds the signal terminal circumferentially.

4. The electrical connector as claimed in claim 3, wherein the inner sides of the two side walls of the first shielding sheet and the outer sides of the two side walls of the second shielding sheet of each terminal group are connected to each other.

5. The electrical connector as claimed in claim 4, wherein the second shielding sheet includes at least one extension arm, and the at least one extension arm is electrically connected to the first shielding sheet of the adjacent terminal group.

6. The electrical connector as claimed in claim 5, wherein the at least one extension arm and the second shielding sheet are integrally stamped and bent.

7. The electrical connector as claimed in claim 6, wherein the at least one extension arm is disposed on the side wall of the second shielding sheet, and the extension arm is in contact with the outer side of the side wall on an adjacent side of the first shielding sheet of the adjacent terminal group.

8. The electrical connector as claimed in claim 3, wherein each terminal group comprises a fixing member, and all the signal terminals and all the first shielding sheets in a same row are integrally formed on the fixing member.

9. The electrical connector as claimed in claim 8, wherein the fixing member has plural mounting grooves on both sides of each differential signal terminal pair, and the two side walls of the second shielding sheet are respectively received in corresponding mounting grooves.

10. The electrical connector as claimed in claim 9, wherein at least one extension arm is provided on each second shielding sheet, and the at least one extension arm is in contact with the side wall adjacent to the first shielding sheet of the adjacent terminal group, thereby sequentially connecting adjacent first shielding sheet and second shielding sheet in the same row.

11. An electrical connector comprising:

an insulative housing defining a plurality of grooves extending in a longitudinal direction;

a plurality of terminal modules disposed and retained in the corresponding grooves, respectively; and each of the terminal modules including an insulative fixing member with a plurality of differential pairs for signal transmission and a plurality of metallic first shielding sheets integrally formed therein via insert-molding, each first shielding sheet defining a first U-shaped structure to partially enclose the corresponding differential pair, and a plurality of metallic second shielding sheets being assembled upon the fixing member; wherein viewed along a mating direction of the connector perpendicular to the longitudinal direction, each second shielding sheet defines a second U-shaped structure opposite to the first U-shaped structure of the corresponding first shielding sheet so as to cooperate with the corresponding first shielding sheet to commonly form a frame like structure for circumferentially shielding the corresponding differential pair therein.

12. The electrical connector as claimed in claim 11, wherein each of the second shielding sheets includes an extension arm extending along the longitudinal direction to contact the neighboring first shielding sheet of the neighboring frame like structure so as to have all frame like structure linked together for enhancement of the shielding and grounding.

13. The electrical connector as claimed in claim 12, wherein each first shielding sheet includes a main wall and a pair of side walls perpendicular to the main wall, and the side walls are longer than the main wall in the mating direction.

14. The electrical connector as claimed in claim 13, wherein each second shielding sheet includes a main plate and a pair of side plates perpendicular to the main plate, and the extension arm extends from one side plate.

15. The electrical connector as claimed in claim 14, wherein the fixing member includes an elongated holding portion extending along the longitudinal direction and a plurality of extension portions extending therefrom in the mating direction to receive the corresponding differential pairs, respectively.

16. The electrical connector as claimed in claim 15, wherein the side walls of the first shielding sheet are longer than the holding portion while shorter than the extension arm in the mating direction.

17. A method of making an electrical connector, comprising steps of:

providing a plurality of differential pairs for signal transmission along the longitudinal direction;

providing a plurality of metallic first shielding sheets along the longitudinal direction wherein each first shielding sheet defines a first U-shaped structure;

insert-molding both the differential pairs and the first shielding sheets with an insulative fixing member to form a terminal module; and assembling a plurality of metallic shielding sheets to the fixing member wherein each second shielding sheet defines a second U-shaped structure opposite to the first U-shaped structure so as to cooperate with the corresponding first shielding sheet to commonly form a frame like structure to circumferentially shield the corresponding differential pair, view along a mating direction of the electrical connector.

18. The method as claimed in claim 17, wherein each second shielding sheet includes an extension arm contact the neighboring first shielding sheet of the neighboring frame like structure.

19. The method as claimed in claim 18, wherein the first shielding sheet is longer than the second shielding sheet in the mating direction.

20. The method as claimed in claim 19, further including a step of providing an insulative housing with at least one elongated groove along the longitudinal direction, and assembling the terminal module into the groove along the mating direction to have the terminal module retained in the groove.

* * * * *